US007159959B2

(12) United States Patent
Schremp

(10) Patent No.: US 7,159,959 B2
(45) Date of Patent: Jan. 9, 2007

(54) METHODS AND SYSTEMS FOR DETECTING ERRORS IN PRINTHEAD PATTERN DATA AND FOR PREVENTING ERRONEOUS PRINTING

(75) Inventor: Donald J. Schremp, San Jose, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 329 days.

(21) Appl. No.: 10/839,577

(22) Filed: May 5, 2004

(65) Prior Publication Data

US 2005/0248604 A1 Nov. 10, 2005

(51) Int. Cl.
*B41J 29/38* (2006.01)

(52) U.S. Cl. ..... 347/5; 347/12; 347/9

(58) Field of Classification Search ..... 347/5, 347/12, 9, 40–43, 50–51
See application file for complete search history.

(56) References Cited

U.S. PATENT DOCUMENTS 6,039,433 A * 3/2000 Kobayashi et al. ..... 347/40
6,171,797 B1 1/2001 Perbost
6,180,351 B1 1/2001 Cattell
6,221,583 B1 4/2001 Kayyem et al.
6,222,664 B1 4/2001 Dorsel
6,232,072 B1 5/2001 Fisher
6,242,266 B1 6/2001 Schleifer et al.
6,251,685 B1 6/2001 Dorsel et al.
6,320,196 B1 11/2001 Dorsel et al.
6,323,043 B1 11/2001 Caren et al.
6,355,921 B1 3/2002 Staton et al.
6,371,370 B1 4/2002 Sadler et al.
6,406,849 B1 6/2002 Dorsel et al.
6,486,457 B1 11/2002 Dorsel et al.
6,518,556 B1 2/2003 Staton et al.
6,793,304 B1 * 9/2004 Kasahara ..... 347/5

* cited by examiner

*Primary Examiner*—Stephen Meier
*Assistant Examiner*—Lam Nguyen

(57) ABSTRACT

Methods, systems and computer readable media for identifying print errors caused by erroneous print pattern data received at the printhead of a printer. Methods, systems and computer readable media are also provided for preventing printing according to erroneous printing pattern data received at the printhead. Methods, systems and computer readable media are provided for enhancing the printing speed of a system adapted to identify or prevent printing errors. Further, methods and systems for providing delayed clocking are used for accurate clocking of a printing signal that is sent back from the printhead to the printhead controller for purposes of comparison with a locally stored set of printhead pattern data.

18 Claims, 12 Drawing Sheets

METHODS AND SYSTEMS FOR DETECTING ERRORS IN PRINTHEAD PATTERN DATA AND FOR PREVENTING ERRONEOUS PRINTING

BACKGROUND OF THE INVENTION

Conventionally, pulse jet technology has been used for various print applications. Typically, pulse jet technology uses a plurality of piezo-electric crystals, where each piezo-electric crystal is connected to a corresponding element of a one- or two-dimensional array of nozzles. Upon electric excitation (or, equivalently fire pulse), each piezoelectric crystal forces viscous fluid through the corresponding nozzle to dispense a predetermined amount of the viscous fluid in a droplet.

Bubble jet technology is also widely used in existing printers. Typically, bubble jet technology uses a thermistor to heat a water-based ink very quickly to form a bubble that causes the ink to shoot from an element of a one- or two-dimensional array of nozzles. As the present invention can be applied to both pulse and bubble jet printers, the following discussion will be limited to only pulse jet printers. However, it should be apparent to one of ordinary skill in the art that the various embodiments of the present invention can be implemented in both pulse and bubble jet printers.

Due to operational uncertainty of conventional pulse jet printers, such as clogging of one or more nozzles, and due to the errors caused by the printhead driver electronics, the printed pattern may not be exactly the same as the intended pattern. In most of the printing applications, a level of such operational uncertainty may be permitted. However, for some applications, such as DNA microarray applications, even one missing spot (or, equivalently feature) may be critical to the quality of printing products. FIG. 1A is a perspective view of a typical substrate 100 bearing multiple microarrays 102, as produced by a conventional pulse jet printer.

FIG. 1B is an enlarged view of a portion of one microarray 102 of FIG. 1A, showing some of spots 104, where each microarray 102 can have more than one hundred thousand spots in an area of less than 20 $cm^2$. Each spot 104 may carry a predetermined moiety or a predetermined mixture of moieties, such as a particular polynucleotide sequence or a predetermined mixture of polynucleotides. This is illustrated in FIG. 1C, where spots 104 are shown as carrying different polynucleotide sequences 106.

Polynucleotide sequences 106 may be formed using repeated steps of printing and chemical treatments. In each step, a nozzle may be fired on the corresponding spot 104 to mount a layer of one nucleotide during a sweep across the substrate. After chemical treatment of the mounted layer, the microarray is printed over again to mount the next layer of nucleotide during the next sweep, followed by another chemical treatment. The steps of printing and chemical treatments are repeated until the polynucleotide sequences 106 are obtained. Any missing layer of each polynucleotide sequence 106 may change the property thereof and, as such, the level of certainty about fluid placement from each nozzle is critical in the DNA microarray application. Existing microarray writers have additional optical systems to check if the spots 104 are properly generated. However, such optical systems cannot detect the missing layer(s) for each spot even though the spots can be detected.

Existing consumer printers are physically much smaller than a microarray writer and are not as susceptible to conditions that might cause a data transmission error. Thus, a current microarray writer checks the data from its printhead controller to printhead driver using a parity check, but does not check the data path from the printhead driver to the printhead. As a consequence, it cannot detect errors made on the printhead driver and/or in the communication to the printhead. Accordingly, there is a need for microarray writers with an ability to detect and/or prevent printing errors caused by the printhead driver electronics and/or communication to the printhead and provide assurance that the microarray writers are working correctly.

SUMMARY OF THE INVENTION

The present invention systems, methods and computer readable media for checking printhead pattern data that control printing operations of a printhead in an inkjet printer, wherein a printhead controller is configured to send printhead pattern data to a printhead interface that is configured to receive the printhead pattern data and fire printing nozzles in accordance with the printhead pattern data. The printhead interface includes means for returning the printhead pattern data to the printhead controller upon firing the printhead nozzles in accordance with the printhead pattern data. The printhead controller includes first means for storing the printhead pattern data at the time that the printhead pattern data are sent to the printhead interface, and second means for receiving the printhead pattern data from the means for returning. The printhead controller further includes means for comparing the printhead pattern data stored in the first means and received by the second means.

Further provided are systems, methods and computer readable media for preventing printhead errors based on erroneous printhead pattern data received at a printhead interface. A printhead controller is configured to send printhead pattern data to a printhead interface that is configured to receive the printhead pattern data and fire printing nozzles in accordance with the printhead pattern data. The printhead interface further includes means for storing a first set of printhead pattern data; means for receiving a second set of printhead pattern data while said means for storing stores said first set of printhead pattern data; and means for returning said first set of printhead pattern data to said printhead controller while said first set is stored in said means for storing. The printhead controller includes first means for storing the first printhead pattern data at the time that the first printhead pattern data are sent to the printhead interface; second means for receiving the first printhead pattern data from the means for returning, and means for comparing the printhead pattern data stored in the first means and received by the second means.

Still further, systems, methods and computer readable media are provided for preventing printhead errors based on erroneous printhead pattern data received at a printhead interface and for improving print speeds. A printhead controller is configured to send printhead pattern data to a printhead interface that is configured to receive the printhead pattern data and fire printing nozzles in accordance with the printhead pattern data. The printhead interface further includes first means for receiving and storing a first set of printhead pattern data; second means for storing the first set of pattern data when the first means sends the first set of printhead pattern data thereto and then receives and stores a second set of printhead instructions; and means for returning the first set of printhead pattern data stored in the first means for storing and receiving to the printhead controller while the first set is stored in the first means for receiving and storing. The printhead controller includes first means for storing the first printhead pattern data at the time that the first printhead pattern data are sent to the first means for receiving and storing; second means for receiving the first printhead pattern data from the means for returning, and means for comparing the printhead pattern data stored in the first means for storing and received by the second means for receiving.

The present invention also includes forwarding a result obtained from any of the methods described herein, transmitting data representing a result obtained from any of the methods described herein, and receiving a result obtained from any of the methods described herein.

These and other advantages and features of the invention will become apparent to those persons skilled in the art upon reading the details of the invention as more fully described below.

DETAILED DESCIPTION OF THE INVENTION

Figure 1A:
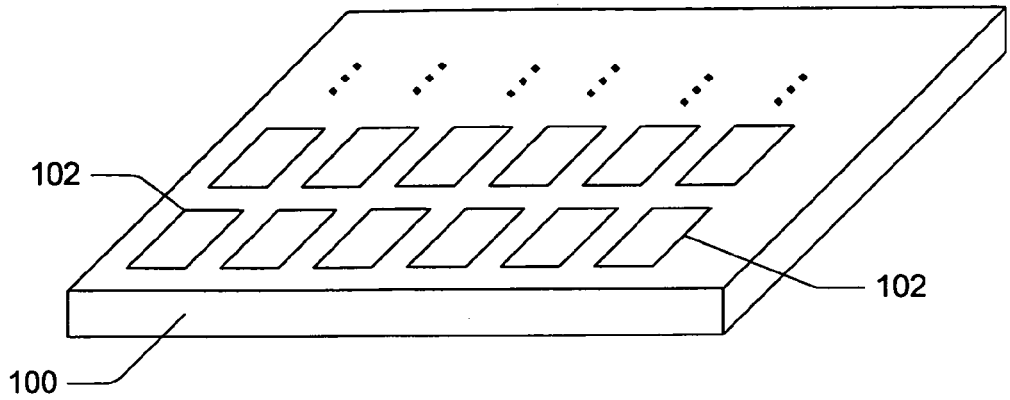
FIG. 1A (PRIOR ART)
FIG. 1A is a perspective view of a typical substrate bearing multiple microarrays, as produced by a conventional pulse jet printer.
Figure 1B:
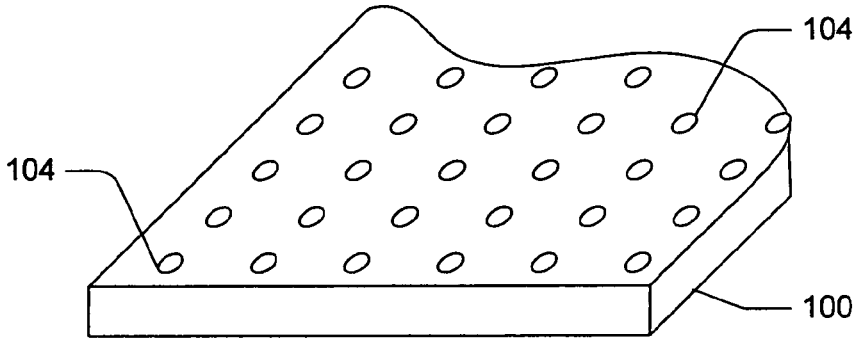
FIG. 1B (PRIOR ART)
FIG. 1B is an enlarged view of a portion of one microarray of FIG. 1A, showing some of the spots.
Figure 1C:
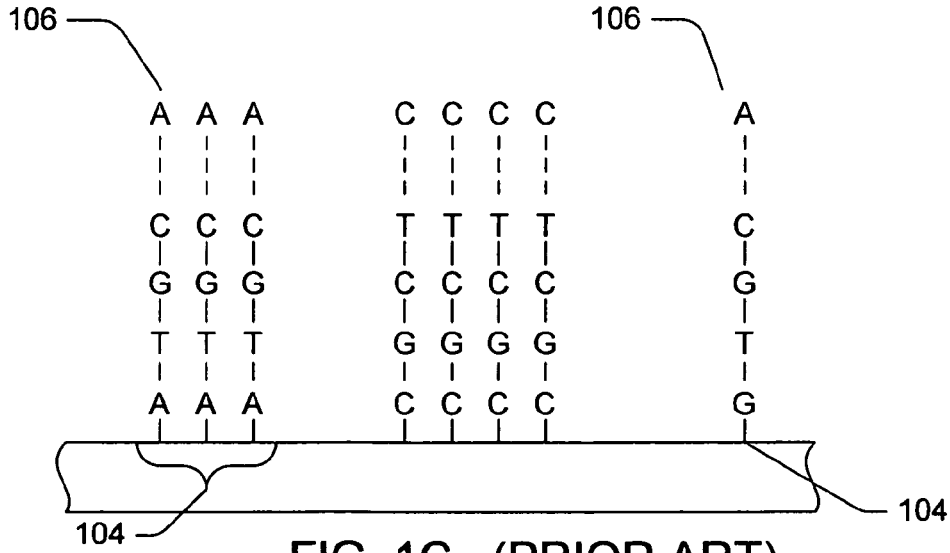
FIG. 1C (PRIOR ART)
FIG. 1C is an enlarged cross-sectional view of a spot in FIG. 1B.

Before the present methods and systems are described, it is to be understood that this invention is not limited to particular printers, methods, method steps, hardware or software described, as such may, of course, vary. It is also to be understood that the terminology used herein is for the purpose of describing particular embodiments only, and is not intended to be limiting, since the scope of the present invention will be limited only by the appended claims.

Unless defined otherwise, all technical and scientific terms used herein have the same meaning as commonly understood by one of ordinary skill in the art to which this invention belongs. Although any methods and materials similar or equivalent to those described herein can be used in the practice or testing of the present invention, the preferred methods and materials are now described. All publications mentioned herein are incorporated by reference to disclose and describe the methods and/or materials in connection with which the publications are cited.

It must be noted that, as used herein and in the appended claims, the singular forms "a", "and", and "the" include plural referents unless the context clearly dictates otherwise. Thus, for example, reference to "the nozzle" includes reference to one or more nozzles and equivalents thereof known to those skilled in the art, and so forth.

The publications discussed herein are provided solely for their disclosure prior to the filing date of the present application. Nothing herein is to be construed as an admission that the present invention is not entitled to antedate such publication by virtue of prior invention. Further, the dates of publication provided may be different from the actual publication dates which may need to be independently confirmed.

Definitions

A "microarray", "bioarray" or "array", unless a contrary intention appears, includes any one-, two- or three-dimensional arrangement of addressable regions bearing a particular chemical moiety or moieties associated with that region. A microarray is "addressable" in that it has multiple regions of moieties such that a region at a particular predetermined location on the microarray will detect a particular target or class of targets (although a feature may incidentally detect non-targets of that feature). Array features are typically, but need not be, separated by intervening spaces. In the case of an array, the "target" will be referenced as a moiety in a mobile phase, to be detected by probes, which are bound to the substrate at the various regions. However, either of the "target" or "target probes" may be the one, which is to be evaluated by the other.

As mentioned, the present invention is directed to various circuits to be implemented in serial inkjet printers that use the "pulse jet" or "bubble jet" technique. Both pulse jet and bubble jet are devices that can dispense drops in the formation of an array. Pulse jets operate by delivering a pulse of pressure to liquid adjacent an outlet or orifice such that a drop will be dispensed therefrom while bubble jet operate by heating the water-based ink very quickly thereby forming a bubble that ejects the ink out of an outlet or orifice. Any given substrate, which can be a 6"×6" or 12"×12" wafer, may carry one, or more arrays disposed on a front surface of the substrate. An array may contain more than ten, more than one hundred, more than one thousand, more than ten thousand features, or even more than one hundred thousand features, in an area of less than 20 $cm^2$ or even less than 10 $cm^2$. For example, features may have widths in the range from about 10 μm to 1.0 cm. In other embodiments, each feature may have a width (that is, diameter for a round spot) in the range of about 1.0 μm to 1.0 mm, and more usually about 10 μm to 200 μm. Non-round features may have area ranges equivalent to that of circular features with the foregoing ranges. At least some, or all, of the features may be of different compositions, each feature typically being of a homogeneous composition within the feature. Interfeature areas will typically be present which do not carry chemical moiety of a type of which the features are composed. Such interfeature areas typically will be present where the arrays are formed by processes involving drop deposition of reagents but may not be present when, for example, photolithographic array fabrication processes are used. It will be appreciated though, that the interfeature areas, when present, could be of various sizes and configurations. Methods to fabricate arrays are described in detail in U.S. Pat. Nos. 6,242,266; 6,232,072; 6,180,351; 6,171,797 and 6,323,043. As already mentioned, these references are incorporated herein by reference. Other drop deposition methods can be used for fabrication, as previously described herein. Also, instead of drop deposition methods, photolithographic array fabrication methods may be used. Interfeature areas need not be present particularly when the arrays are made by photolithographic methods as described in those patents.

Following receipt by a user, an array will typically be exposed to a sample and then read. Reading of an array may be accomplished by illuminating the array and reading the location and intensity of resulting fluorescence at multiple regions on each feature of the array. For example, a scanner may be used for this purpose is the AGILENT MICROARRAY SCANNER manufactured by Agilent Technologies, Palo, Alto, Calif. or other similar scanner. Other suitable apparatus and methods are described in U.S. Pat. Nos. 6,518,556; 6,486,457; 6,406,849; 6,371,370; 6,355,921; 6,320,196; 6,251,685 and 6,222,664. However, arrays may be read by any other methods or apparatus than the foregoing, other reading method including other optical techniques or electrical techniques (where each feature is provided with an electrode to detect bonding at that feature in a manner disclosed in U.S. Pat. Nos. 6,251,685, 6,221,583 and elsewhere).

When one item is indicated as being "remote" from another, this is referenced that the two items are at least in different buildings, and may be at least one mile, ten miles, or at least one hundred miles apart.

"Communicating" information references transmitting the data representing that information as electrical signals over a suitable communication channel (for example, a private or public network).

"Forwarding" an item refers to any means of getting that item from one location to the next, whether by physically transporting that item or otherwise (where that is possible) and includes, at least in the case of data, physically transporting a medium carrying the data or communicating the data.

A "processor" references any hardware and/or software combination which will perform the functions required of it. For example, any processor herein may be a programmable digital microprocessor such as available in the form of a mainframe, server, or personal computer. Where the processor is programmable, suitable programming can be communicated from a remote location to the processor, or previously saved in a computer program product. For example, a magnetic or optical disk may carry the programming, and can be read by a suitable disk reader communicating with each processor at its corresponding station.

Reference to a singular item, includes the possibility that there are plural of the same items present.

"May" means optionally.

Methods recited herein may be carried out in any order of the recited events which is logically possible, as well as the recited order of events.

All patents and other references cited in this application, are incorporated into this application by reference except insofar as they may conflict with those of the present application (in which case the present application prevails).

A conventional microarray writer checks the nozzle pattern data stream from its printhead controller to printhead driver using a parity check, but does not check the data all the way to the printhead. As a consequence, it cannot detect data stream errors made on the printhead driver and/or in the communication to the printhead.

The present invention provides methods, hardware and computer readable media for performing a check on the data coming back from the printhead to detect errors made on the printhead driver and/or in the communication to the printhead. Such detection may enable subsequent removal or repair of defective microarray products. Also, the present invention provides methods, hardware and computer readable media for preventing printing errors made on the printhead driver and/or in the communication to the printhead.

Figure 2:
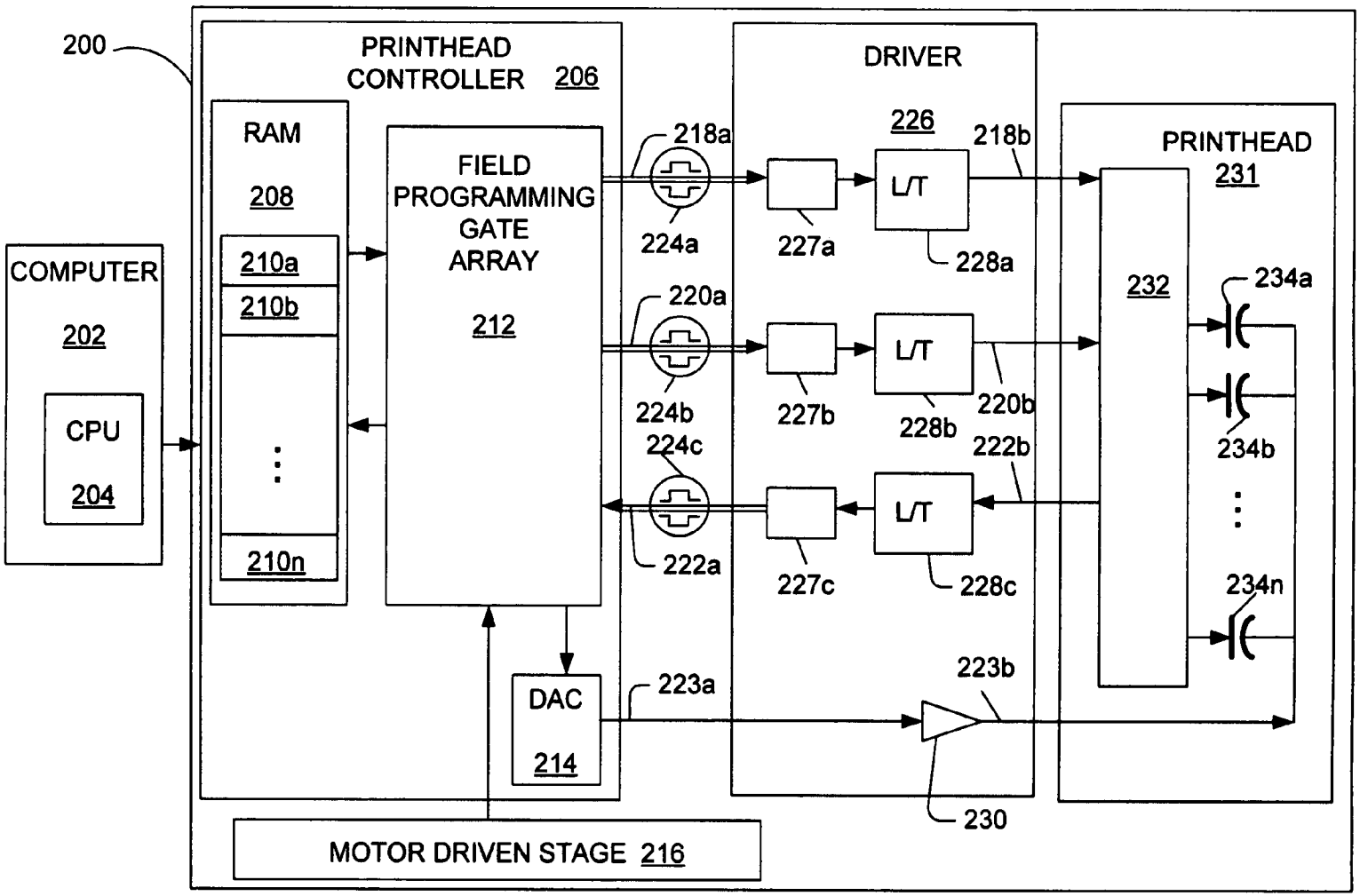
FIG. 2 is a schematic diagram of a printing system in accordance with one embodiment of the present teachings.

Referring to FIG. 2, a schematic diagram 200 of a printing system, preferentially a microarray writer, connected to a computer is shown, illustrating data flow between the printing system and the computer in accordance with one embodiment of the present teachings. Printhead controller 206 includes: random access memory (RAM) 208 for storing data received from CPU 204 of computer 202; field programming gate array (FPGA) 212 for receiving data 210 from RAM 208, sending address information to RAM 208 and receiving position information signals from motor driven stage 216; digital-to-analog converter (DAC) 214 for converting digital fire pulse signals received from FPGA 212 into analog fire pulse signals and sending the analog fire pulse signals through line 223*a*.

Printhead driver (driver) 226 connected to printhead controller 206 and printhead interface 232, includes differential receivers 227*a–c* for converting differential signals into non-differential signal format; level translators 228*a–c* for translating signals received from or sent to differential receivers 227*a–c* and printhead controller 206; and amplifier 230 for receiving fire pulse signals from DAC 214 through line 223*a* and amplifying the signals before sending to printhead interface 232 through line 223*b*. Driver 226 receives nozzle pattern data in a serial format through line 220*a* and clock signals through line 218*a* and sends serial data (named as "signal-data-in") to FPGA 212 through line 222*a*. As will be explained later, the serial-data-in is the same as the actual nozzle pattern data used to control nozzle array 234 of printhead interface 232. As shown in inset diagrams 224*a–c*, FPGA 212 and driver 226 exchange data in a differential signal format that has an advantage over a normal single-ended (i.e., non-differential) signal in that the non-differential signal is susceptible to electrical noise and/or the difference in ground voltages of FPGA 212 and driver 226. Each of differential receivers 227*a–c* is responsive to the difference in voltage between two signals within a differential pair and operative to translate the differential signal into a non-differential signal before sending to level translators 228*a–c* which translate the non-differential signal to a higher voltage signal that is then sent to printhead interface 232.

Printhead 231 includes printhead interface 232 and nozzle array 234 (the nozzles in FIG. 2 comprise piezoelectric crystals represented as capacitors in FIG. 2) Printhead interface 232 receives a clock signal from level translator 228*a* through line 218*b* and nozzle/printhead pattern data from level translator 228*b* through line 220*b*. It also sends the signal-data-in to level translator 228*c* through line 222*b*.

Fire pulse signals from amplifier 230 activate nozzle array 234 to print in accordance with the nozzle pattern data from level translator 228*b*.

Figure 3:
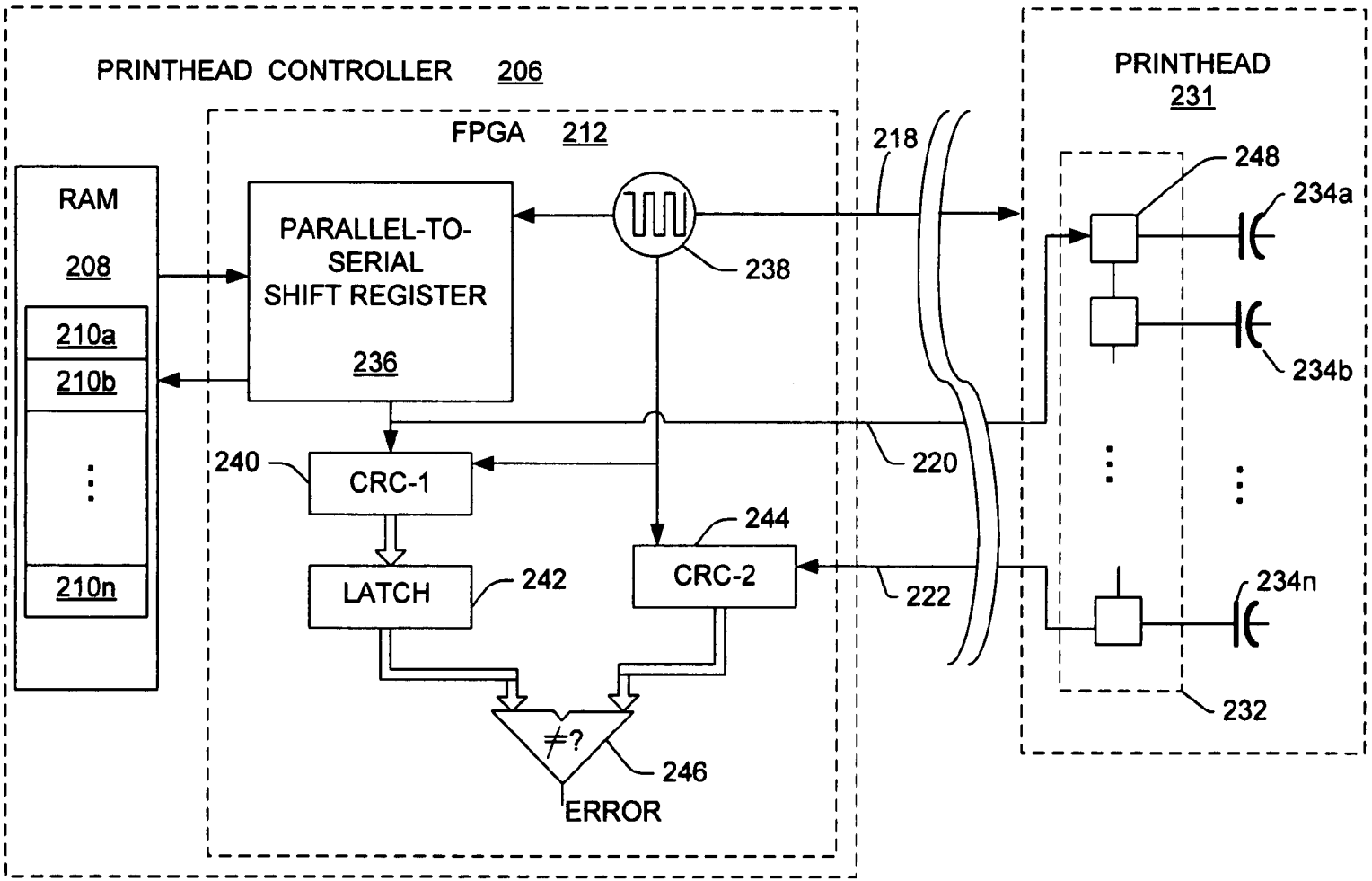
FIG. 3 is a detailed circuit diagram of a printhead controller and printhead of the printing system shown in FIG. 2, where the printhead controller and printhead have a capability of detecting printing errors.

FIG. 3 is a detailed diagram of printhead controller 206 and printhead 231 of FIG. 2, with the fire pulse portion of the circuit not shown. Also, driver 226 is not shown for simplicity. As shown in FIG. 3, FPGA 212 includes: clock 238 for providing clock signals; parallel-to-serial shift register 236 for the serializing nozzle pattern data 210*a* received from RAM 208 and sending the serialized nozzle pattern data clocked using a clock signal from clock 238; first cyclic redundancy code circuit (CRC-1) 240 for receiving the serialized nozzle pattern data from parallel-to-serial shift register 236; latch 242 for receiving CRC data from CRC-1 240 and latching the received CRC data; second CRC circuit (CRC-2) 244 for receiving serial-data-in from printhead interface 232; and comparator 246 to compare the latched CRC data received from latch 242 with the serial-data-in CRC data received from CRC-2 244 to check printing errors. The CRC circuits 240 and 244 are conventional cyclic redundancy code devices that are used for detecting errors in serial data communications.

RAM 208 stores data 210 that is pre-determined by computer 202 and sends data 210 to FPGA 212 in a parallel format, where data 210 may include nozzle pattern data 210*a*, trigger position data 210*b*, waveform data 210*c* for fire pulse signals and other data related to the printing process.

As mentioned above, parallel-to-signal shift register 236 serializes nozzle pattern data 210*a* received from RAM 208 and clocks out the serialized nozzle pattern data, namely as serial-data-out. Hereinafter, the terms "nozzle pattern data" and "serial-data-out" are used interchangeably. The serial-data-out is sent to printhead interface 232 through line 220 as well as cyclic redundancy code circuit (CRC-1) 240.

Printhead interface 232 loads the signal-data-out into shift register 248, where each element (or, equivalently bit) of shift register 248 is coupled to one element of nozzle array 234. The size of shift register 248, which depends on the number of nozzle array elements, can be, but is not limited to, 128 bits. Upon receiving a fire pulse signal from amplifier 230 (shown in FIG. 2), printhead nozzle array 234 prints in accordance with the nozzle pattern data stored in shift register 248.

Trigger position data 210*b* includes position information for firing nozzle array 234. As printhead 231 scans across array 102 (shown in FIG. 1A), motor driven stage 216 sends position information signals to FPGA 212. Based on the position information signals and trigger position data 210*b*, FPGA 212 sends fire pulse signals to printhead interface 232 via DAC 214. Shapes of the fire pulse signals are determined by waveform data 210*c* received from RAM 208.

As mentioned above, printhead interface 232 sends the serial-data-in to FPGA 212 through line 222. The serial-data-in is the same as the actual nozzle pattern data that is stored in shift register 248 and subsequently used to activate nozzle array 234 upon receipt of a fire pulse signal. The serial-data-in is clocked into CRC-2 244 using the clock signals received from clock 238. Because the serial-data-in stays in shift register 248 of printhead interface 232 until the next serial-data-out is clocked into printhead interface 232 through line 220, the signal-data-out stored in CRC-1 240 is transferred and latched in latch 242 until the matching serial-data-in is clocked back into CRC-2 244. Thus, in this approach, the last serial-data-out is stored in latch 242, while the serial-data-in is clocked back into CRC-2 244 upon sending a dummy serial-data-out to printhead interface 232. If the serial-data-out in latch 242 does not match the serial-data-in in CRC-2 244, comparator 246 signals a printing error message.

CRC circuits 240, 244 take data in a serial pattern and generate data in 16-bit paired code, where the block integrity of the data is verified. The advantage of using CRC circuits 240, 244 are; (1) the circuit of FPGA 212 shown in FIG. 3 does not need to be changed even though the length of each nozzle pattern data may change, (2) the implementation of the circuit of FPGA 212 is smaller than alternative circuits if the printhead interface 232 has more than 16 nozzles and (3) the error check can be done on a per fire or a per print swath basis. The error check can be made after each fire pulse, i.e., per fire basis in one embodiment. In an alternative embodiment, the error can also be checked after all the spots across the substrate have been printed, i.e., per print swath basis. This approach can be applied to the case where the error cannot be checked on the fly due to the time allocated for the error check per fire basis.

In another embodiment of the present teachings, CRC circuits 240, 244 may be replaced with two serial-to-parallel shift registers. Use of shift registers makes the implementation of the circuit of FPGA 212 simpler if printhead interface 232 is based on a 16-bit or less layout. However, if the bit size increases, the size of the two shift registers and their related circuits should increase to accommodate this increase in size.

Figure 4:
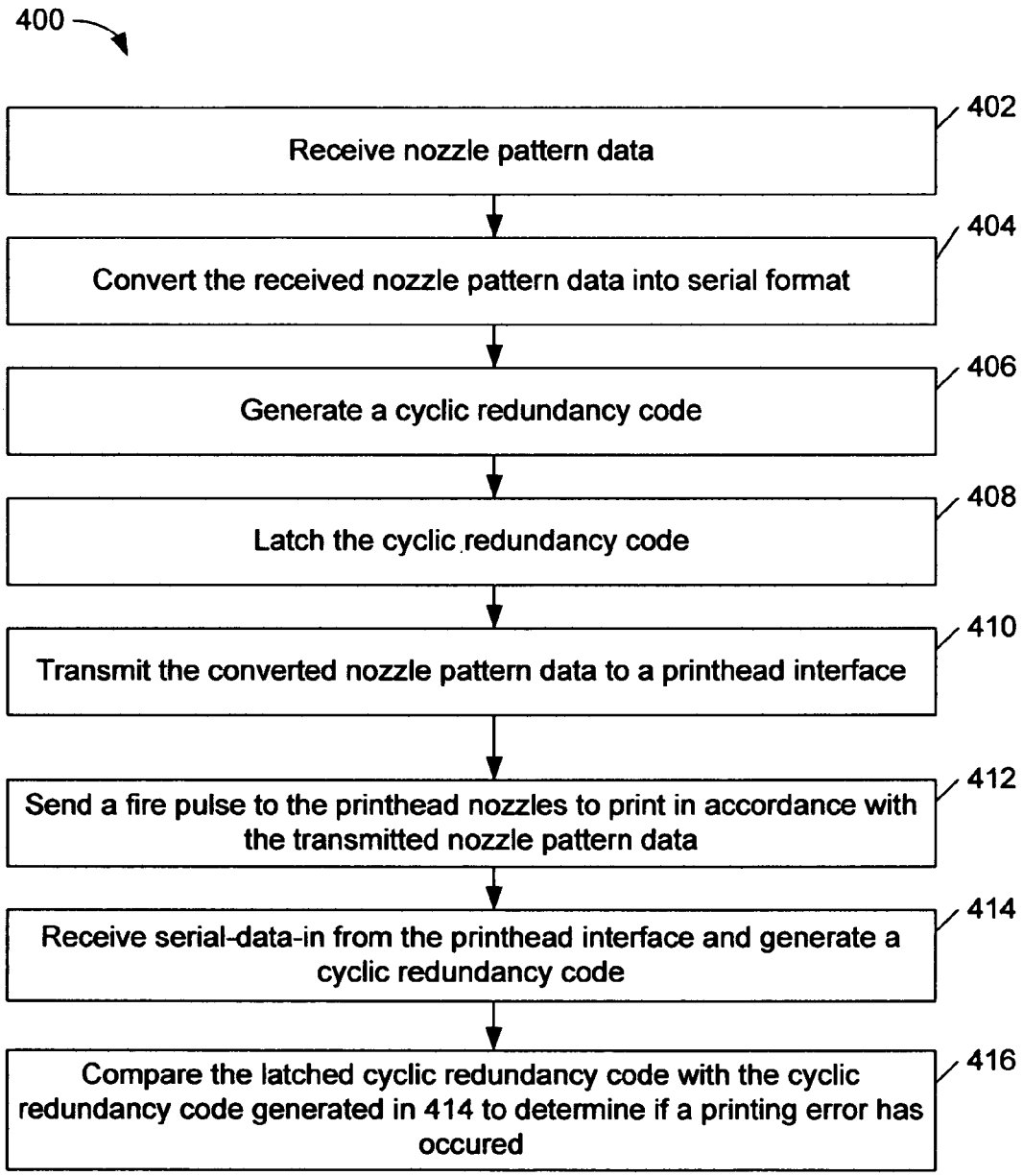
FIG. 4 is a flow chart illustrating steps of detecting printing errors using the circuits of FIGS. 2 and 3.

FIG. 4 shows a flow chart 400 indicating an example of steps that may be taken as an approach to detect printing errors using the circuits shown in FIGS. 2 and 3. At steps 402 and 404, a circuit (e.g. FPGA) receives nozzle pattern data and converts the nozzle pattern data into serial format. Next, a cyclic redundancy code is generated from the converted nozzle pattern data by first CRC circuit 240 at step 406. Then, the CRC is latched by latch 242 at step 408. At step 410, the converted nozzle pattern data is transmitted to printhead interface 232. Then, at step 412, a fire pulse is sent to printhead nozzles 234 to print in accordance with the transmitted nozzle pattern data. Next, second CRC circuit 244 receives serial-data-in from printhead interface 232 and generates a cyclic redundancy code at step 414. Finally, at step 416, comparator 246 compares the latched outgoing CRC in latch 242 with the serial-data-in CRC in second CRC circuit 244 to check if a printing error has occurred. If the latched CRC does not match the serial-data-in CRC, it is determined that a printing error has occurred.

Several state machines (not shown in FIGS. 2–3 for simplicity) may be provided to orchestrate the steps of flow chart 400. For example, one state machine in FPGA 212 controls when to take data 210 from RAM 208 and receive the serial-data-in from printhead interface 232, etc. The state machine may be connected to a 60 MHZ clock and make a decision each time a clock signal is received.

Figure 5:
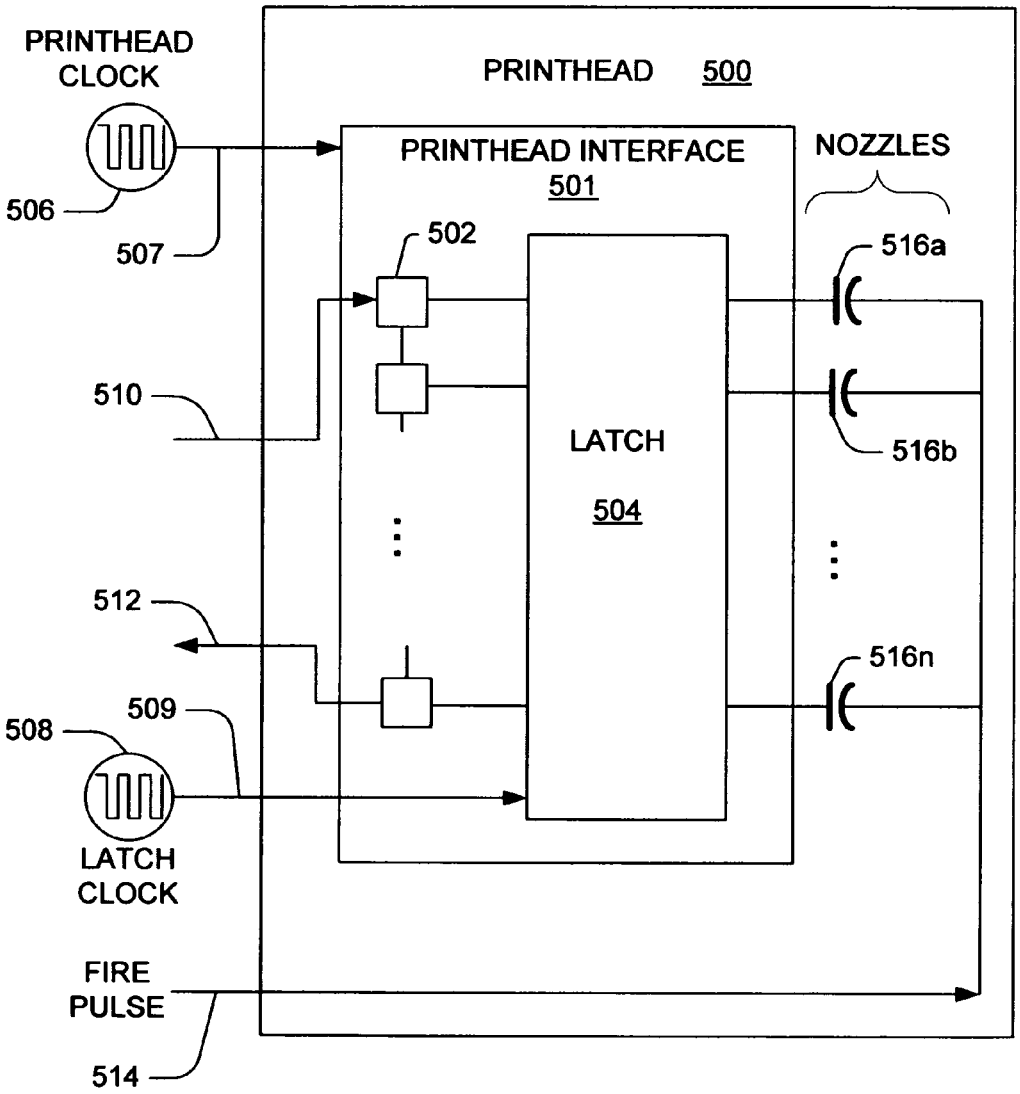
FIG. 5 is a circuit diagram of a printhead implemented to prevent printing errors in accordance with one embodiment of the present teachings.

Referring now to FIG. 5, a modified printhead interface 501 to prevent printing error is illustrated in accordance with one embodiment of the present teachings. As shown in FIG. 5, printhead 500 includes modified printhead interface 501 and printhead nozzles 516. Printhead interface 501 includes shift register 502 for receiving and shifting nozzle pattern data from an FPGA through line 510 and for sending serial-data-in to the FPGA through line 512, and latch 504 for latching the shifted nozzle pattern data received from shift register 502. First signal line 507 transmits clock signals from printhead clock 506 to printhead interface 501. Second signal line 509 transmits clock signals from latch clock 508 to printhead interface/latch 501/504. Line 514 transmits fire pulse signals from the FPGA and amplifier to nozzle array 516, which is also coupled to latch 504. Printhead clock 506, which may be clock 238, is used to clock in the nozzle pattern data sent by the FPGA through line 510.

Figure 6A:
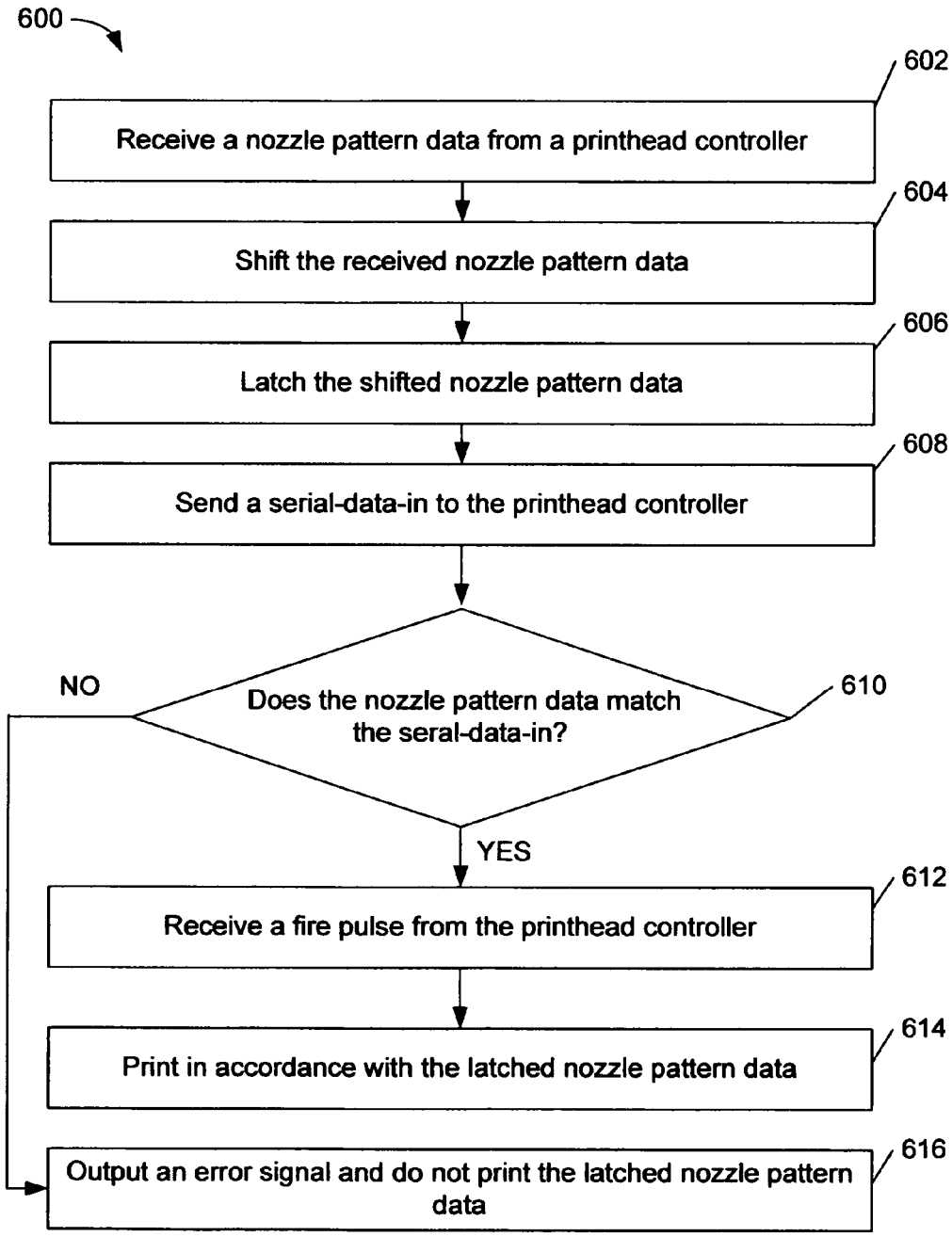
FIG. 6A is a flow chart illustrating steps to prevent printing errors using the printhead shown in FIG. 5.

FIG. 6A shows a flow chart 600 indicating an example of steps that may be taken as an approach to prevent printing errors using the printhead interface arrangement of FIG. 5. At step 602, nozzle pattern data is received from a printhead controller, e.g. an FPGA in a printhead controller, through line 510. Then, shift register 502 shifts the received nozzle pattern data at step 604. Subsequently, the shifted nozzle pattern data is transferred to and latched in latch 504 at step 606. Next, at step 608, serial-data-in is sent to the printhead controller, more specifically to a CRC circuit, through line 512, where the serial-data-in is the same as the nozzle pattern data latched in latch 504. Then, at step 610, a comparator in the FPGA compares the outgoing nozzle pattern data CRC with the serial-data-in CRC in the CRC circuit to detect if any error has occurred. In case of a match, the FPGA sends a fire pulse signal to printhead 500 through signal line 514 at step 612. Accordingly, nozzle array 516 is activated to print in accordance with the latched nozzle pattern data at step 614. If the answer to step 610 is negative, an error signal is outputted and the latched nozzle pattern data is not printed at step 616.

Latch 504 can also be used to speed up the printing process. Typically, the rate of printing is limited by several factors. One of them is the length of time it takes to load the nozzle pattern data into the printhead. In an alternative embodiment, to enhance the printing speed of two consecutive nozzle pattern data, the following nozzle pattern data can be loaded in shift register 502 while the preceding one latched in latch 504 is being printed. In one embodiment of the present teachings, this process can be accomplished by performing steps 612–614 in parallel with steps 602–608.

Figure 6B:
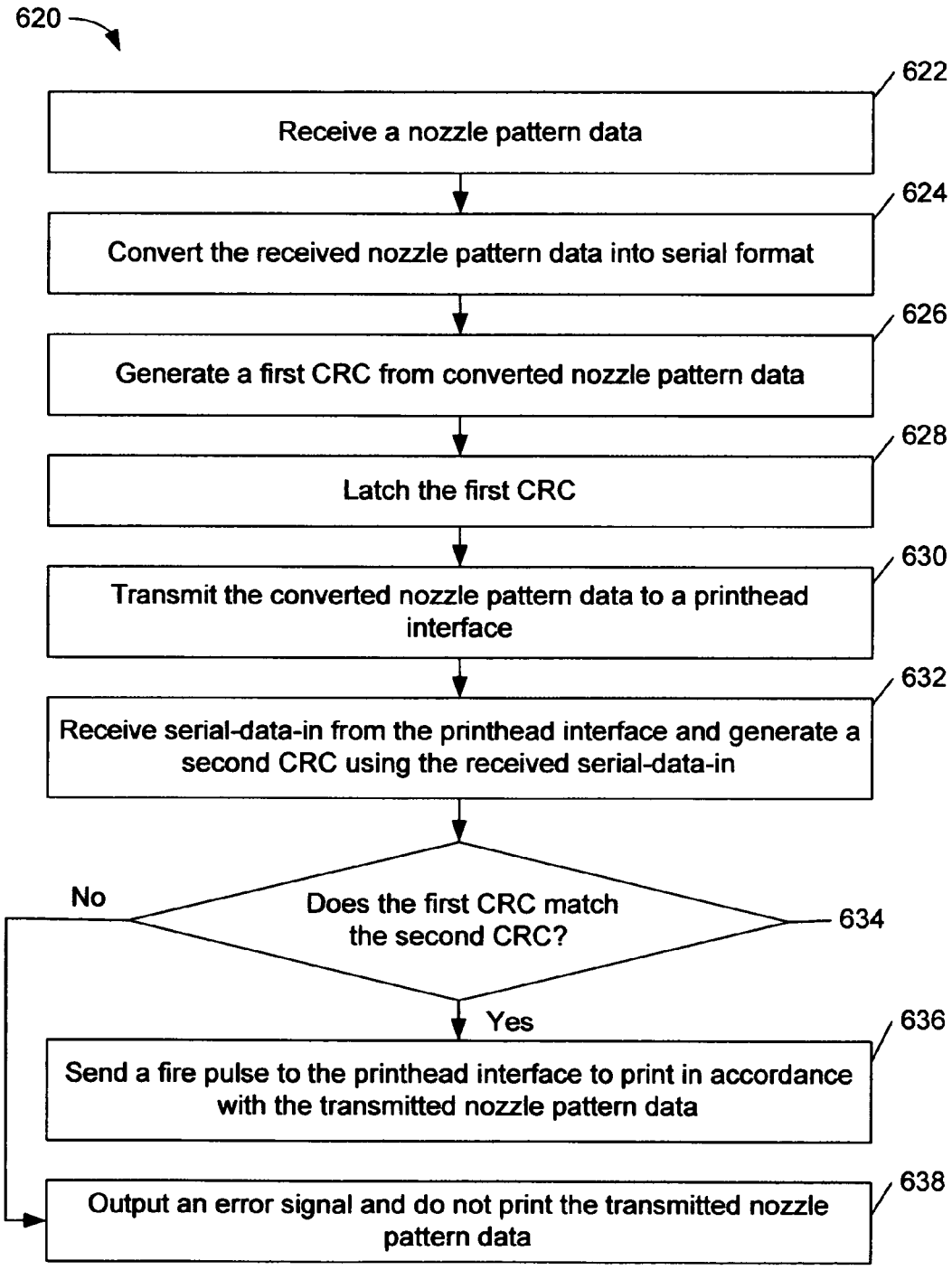
FIG. 6B is a flow chart illustrating steps to prevent printing errors using the FPGA shown in FIG. 3 in conjunction with the printhead shown in FIG. 5.

FIG. 6B shows a flow chart 620 indicating an example of steps that may be taken as an approach to prevent printing errors using the arrangement shown in FIG. 3 in conjunction with printhead 500 shown in FIG. 5. At step 622, FPGA 212 receives nozzle pattern data from data memory 208. Then, the received nozzle pattern data is converted into serial format by parallel-to-serial shift register 236 at step 624. Next, a CRC is generated from the converted nozzle pattern data by CRC-1 240 at step 626 and latched by latch 242 at step 628. At step 630, the converted nozzle pattern data is transmitted to printhead interface 501. Next, CRC-2 244 receives serial-data-in from printhead interface 501 at step 632 and the received serial-data-in CRC is compared with the latched CRC in latch 242 at step 634. If they match, a fire pulse is sent to printhead 500 at step 636. If they do not match, a printing error signal is outputted and the transmitted nozzle pattern data is not printed at step 638.

Figure 7:
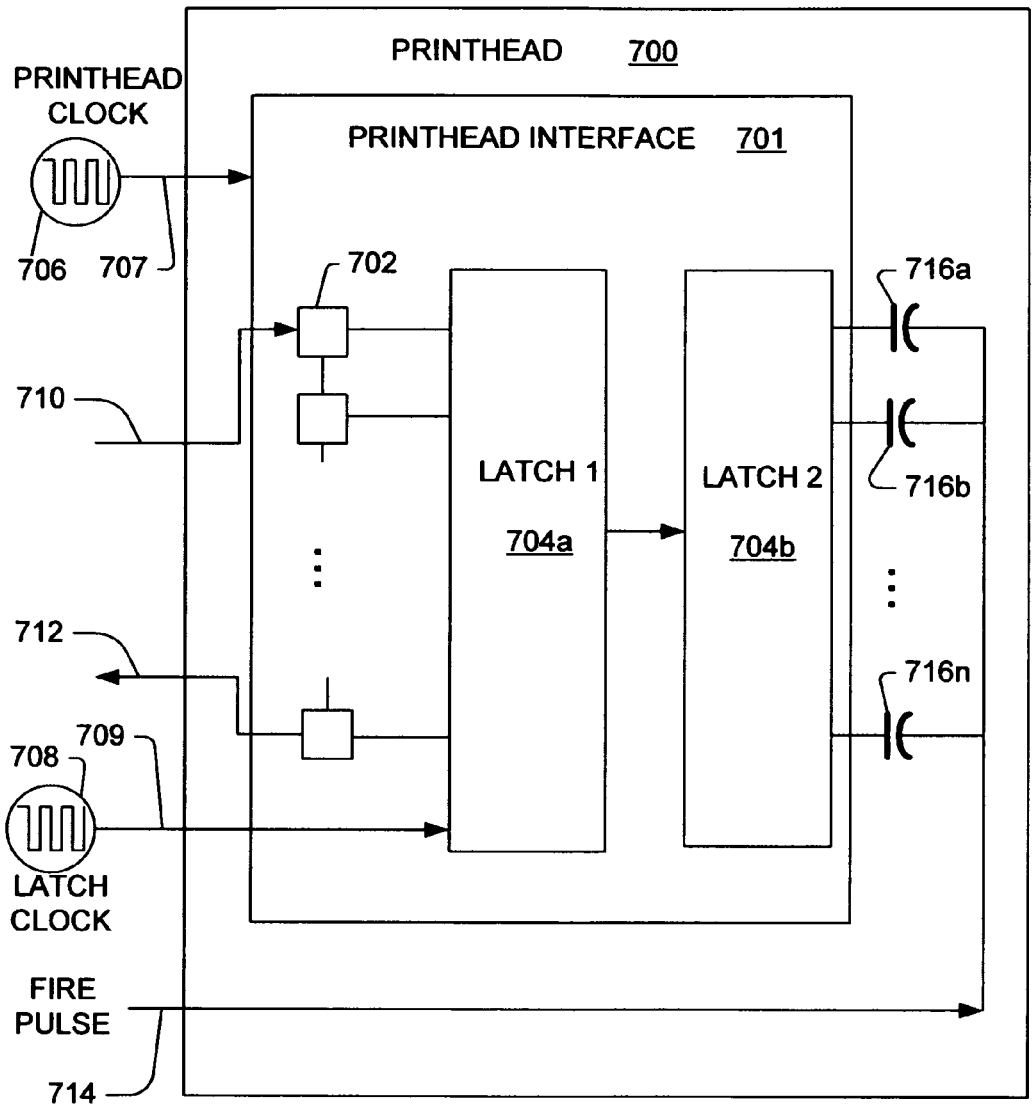
FIG. 7 is a circuit diagram of a printhead implemented to prevent printing errors and enhance printing speed in accordance with another embodiment of the present teachings.

As mentioned, the printhead circuit shown in FIG. 5 can be used to enhance the printing speed by performing steps 612–614 in parallel with steps 602–608 (see flow chart 600 in FIG. 6A). FIG. 7 shows a printhead 700 having a printhead interface 701 implemented to prevent printing errors and enhance printing speed as mentioned. As shown in FIG. 7, printhead interface 701 includes: shift register 702 for receiving and shifting nozzle pattern data from an FPGA through line 710 and for sending serial-data-in to the FPGA through line 712; first latch 704*a* for latching the shifted nozzle pattern data received from shift register 702; and second latch 704*b* for latching the nozzle pattern data received from first latch 704*a*. First signal line 707 transmits clock signals from printhead clock 706 to printhead interface 701. Second signal line 709 transmits clock signals from latch clock 708 to printhead interface (latches) 701. Third line 714 transmits fire pulse signals from the FPGA/amplifier to printer nozzles/nozzle array 716. Nozzle array 716 is also coupled to second latch 704*b*. Printhead clock 706, which may be clock 238, is used to clock in the nozzle pattern data sent by the FPGA through line 710.

Figure 8:
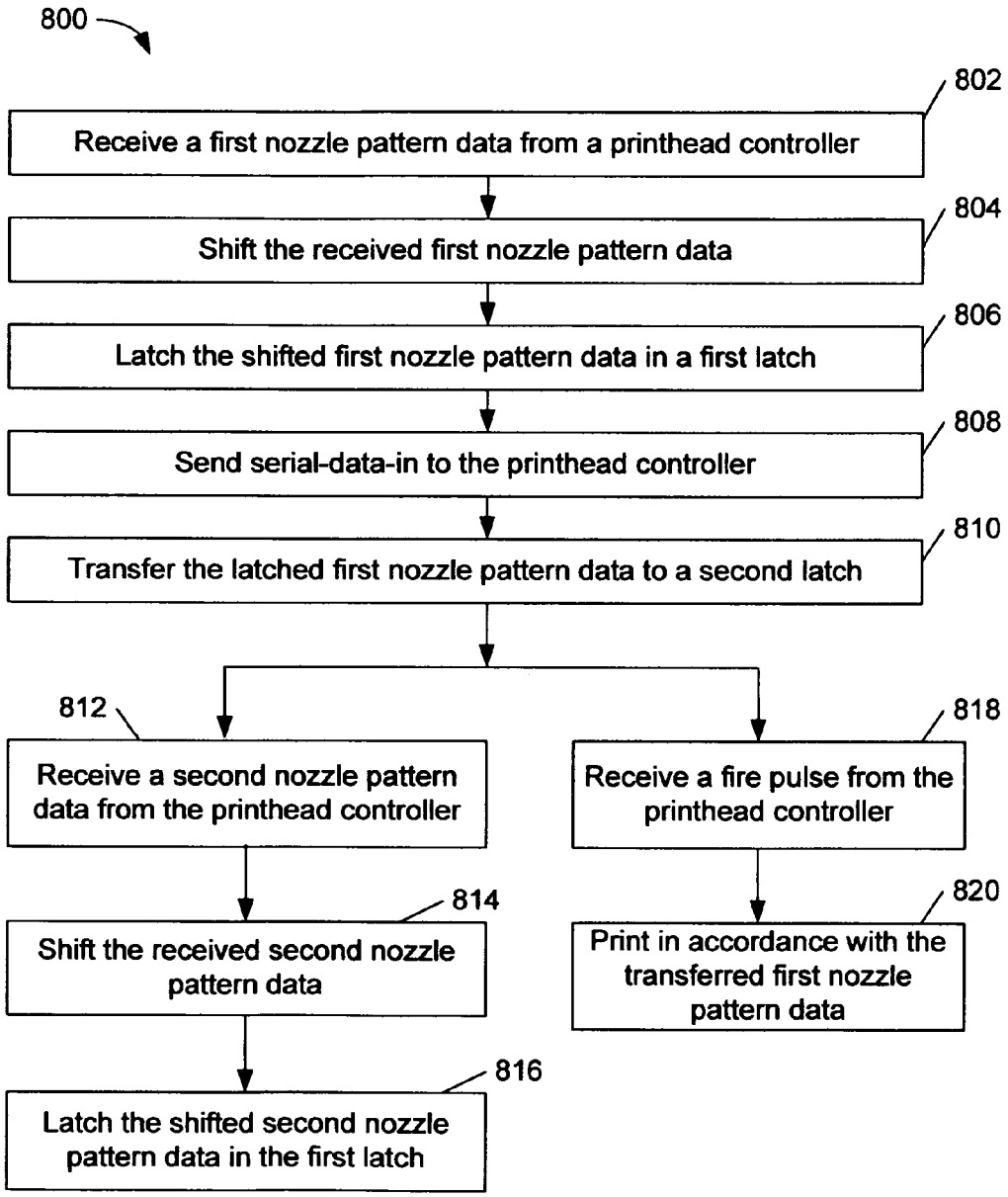
FIG. 8 is a flow chart illustrating steps to prevent printing errors and enhance printing speed using the printhead circuit shown in FIG. 7.

Referring now to FIG. 8, flow chart 800 indicates an example of steps that may be taken as an approach to prevent printing errors and enhance printing speed using printhead 700 shown in FIG. 7. At step 802, a first nozzle pattern data is received from a printhead controller through line 710. Next, the received first nozzle pattern data is shifted by shift register 702 and latched in first latch 704*a* at steps 804 and 806, respectively. Then, serial-data-in is sent to printhead controller at step 808 through line 712. At step 810, the latched first nozzle pattern data is transferred to second latch 704*b*. Subsequently, a second nozzle pattern data is received from the printhead controller through line 710 at step 812. The received second pattern data is shifted and latched in first latch 704*a* at steps 814 and 816, respectively. The CRC of the serial-data-in sent to the printhead controller is compared to the CRC of the first nozzle pattern data to check printing errors. In case of a match, a fire pulse signal is received through line 714 at step 818 and nozzle array 716 is activated to print in accordance with the transferred first nozzle pattern data at step 820.

As explained in flow chart 800, the first nozzle pattern data transferred to and latched in second latch 704*b* is printed while following nozzle pattern data is shifted and latched in first latch 704*a*. Thus, printhead interface circuit 701 employs parallel processing to reduce the time interval between successive printing operations.

Figure 9:
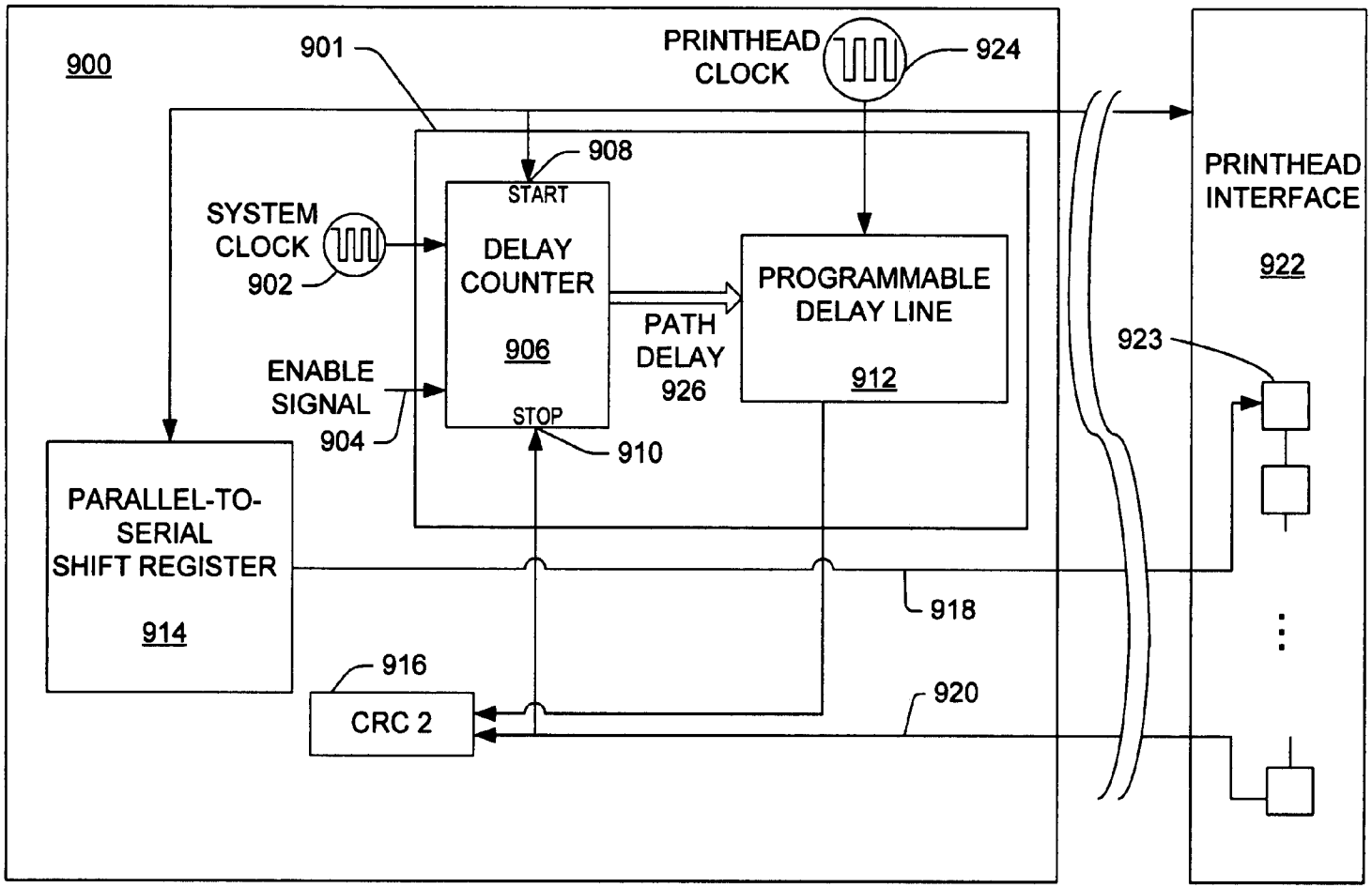
FIG. 9 shows a schematic diagram of a delay circuit to delay a printhead clock using a measured path delay in accordance with one embodiment of the present teachings.

One problem with performing a readback check as described is that there can be significant delays that occur during transmission of data from printhead controller 206 (shown in FIG. 3) to printhead interface 232 and back. This delay can make it impossible to clock serial-data-in into CRC circuit 244 with the same clock 238 used to clock the corresponding nozzle pattern data sent to printhead interface 232 through line 220. FIG. 9 shows a delay circuit 901 implemented within FPGA 900 to measure the path delay from FPGA 900 to a printhead and back to FPGA 900 and to delay a printhead clock by the same amount as the measured path delay in accordance with one embodiment of the present teachings. For simplicity, only a portion of FPGA 900 is shown in FIG. 9.

As illustrated in FIG. 9, delay circuit 901 includes: delay counter 906 for receiving an enable signal through line 904 to enable the operation thereof, start signal 908 to start counting a path delay, stop signal 910 to stop counting the path delay and system clock signals from system clock 902 and for sending measured path delay 926 (or, equivalently counter value) that is the elapsed time between start signal 908 and stop signal 910; and programmable delay line 912 for receiving the path delay from delay counter 906 and delaying printhead clock 924.

Parallel-to-serial shift register 914 clocks out nozzle pattern data to printhead interface 922 using a clock signal from printhead clock 924, where printhead interface 922 shifts the received nozzle pattern data and stores the nozzle pattern data in shift register 923. The measurement of a delay begins with a clock edge sent by printhead clock 924, where the clock edge makes a known transition on the serial-data-in line 920 (zero to one transition). The known transition is set up by first filling shift register 923 with zeros, then ones, which is performed in two steps. At the first step, shift register 923 is prepared to have a specific bit pattern before enabling delay counter 906, where the specific bit pattern has ones except for the last bit. At the second step, the clock edge causes the last bit to go from zero to one. The clock edge that would cause the last bit to go from zero to one is the same as start signal 908 that starts delay counter 906. Printhead interface 922 sends the serial-data-in that has the known transition to both CRC circuit 916 and delay counter 906 through serial-data-in line 920, where the known transition is used as stop signal 910 for delay counter 906. Delay counter 906 uses the system clock signal received from system clock 902, measures the delay value as a number of system clock periods, and passes the counter value (or, equivalently path delay) to programmable delay line 912. Programmable delay line 912 delays printhead clock 924 by the same amount as the counter value so that delayed printhead clock 924 is now closely related to the serial-data-in and can be used to clock in the serial-data-in received by CRC circuit 916.

Figure 10:
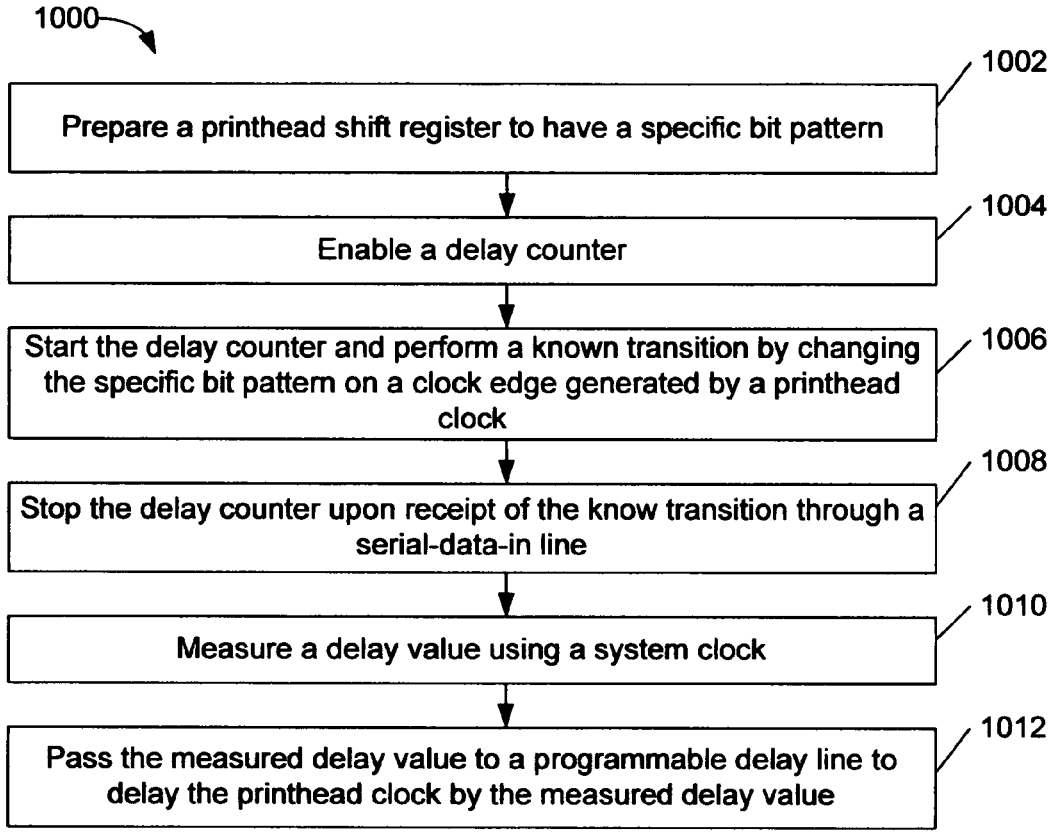
FIG. 10 is a flow chart illustrating steps to delay a printhead clock using the delay circuit of FIG. 9.

FIG. 10 shows a flow chart 1000 illustrating the steps that may be taken as an approach to delay a printhead clock to compensate a path delay using delay circuit 901 shown in FIG. 9. At step 1002, printhead shift register 923 is prepared to have a specific bit pattern. Next, at step 1004, delay counter 906 is enabled upon receiving an enable signal through line 904. Then, delay counter 906 starts counting and a known (zero-to-one) transition is performed by changing the specific bit pattern upon receipt of the next clock edge generated by printhead clock 924 at step 1006. At step 1008, delay counter stops counting when the known transition is received through serial-data-in line 920. At step 1010, delay counter 906 measures a delay value using system clock 902, where the delay value corresponds to the elapsed time. Subsequently, delay counter 906 passes the delay value to programmable delay line 912 so that programmable delay line 912 delays printhead clock 924 by the same amount as the delay value at step 1012.

In another embodiment, setup time and error buffer can be added thereby making programmable delay line 912 delay slightly longer than the counter value to provide data setup time to the CRC circuit. The delay may be measured at the start of each print swath compensating for any changes that occur over time and temperature.

Figure 11:
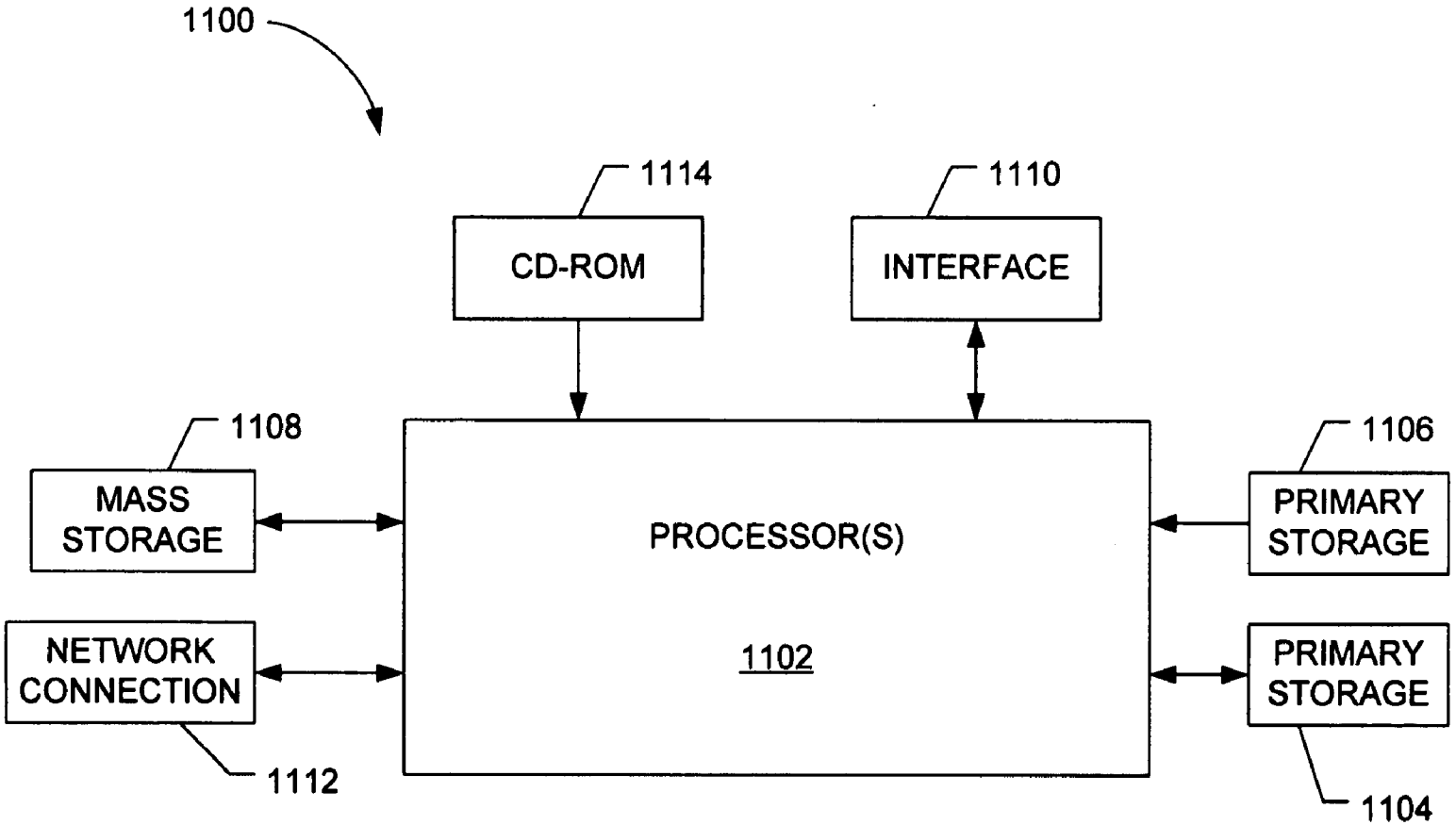
FIG. 11 is a block diagram illustrating an example of a generic computer system that may be used in implementing the present invention.

FIG. 11 illustrates a typical computer system in accordance with an embodiment of the present invention. Computer system 1100 includes any number of processors 1102 that are coupled to storage devices including primary storages 1104 and 1106. As is well known in the art, primary storage 1106 acts to transfer data and instructions uni-directionally to the CPU and primary storage 1104 is used typically to transfer data and instructions in a bi-directional manner. Both of these primary storage devices may include any suitable computer-readable media. Mass storage device 1108 is also coupled bi-directionally to CPU 1102 and provides additional data storage capacity and may include any of the computer-readable media. Mass storage devices 1108 may be used to store programs, data and the line and is typically a secondary storage medium such as a hard disk that is slower than primary storage. It will be appreciated that the information retained within mass storage device 1108, may, in appropriate cases, be incorporated in standard fashion as part of primary storage 1106 as virtual memory. A specific mass storage device such as CD-ROM 1114 may also pass data uni-directionally to the CPU.

CPU 1102 is also coupled to interface 1110 that includes one of more input/output devices such as video monitors, track balls, mice, keyboards, microphones, touch-sensitive displays, transducer card readers, magnetic or paper tape readers, tablets, styluses, voice or handwriting recognizers, or other well-known input devices such as, of course, other computers. Finally, CPU 1102 optionally may be coupled to a computer or telecommunications network using a network connection as shown generally at 1112. With such a network connection, it is contemplated that CPU 1102 might receive information from the network, or might output information to the network in the course of performing the above-described method steps. The above-described devices and materials will be familiar to those of skill in the computer hardware and software arts.

The hardware elements described above may implement the instructions of multiple software modules for performing the operations of this invention. In addition, embodiments of the present invention further relate to computer readable media or computer program products that include program instructions and/or data for performing various computer-implemented operations. The media and program instructions may be those specially designed and constructed for the purposed of the present invention, or they may be of the kind well known and available to those having skill in the computer software arts. Examples of computer-readable media includes, but not limited to, magnetic media such as hard disks, floppy disks, and magnetic tape; optical media such as CD-ROM, CDRW, DVD-ROM, or DVD-RW disks; magneto-optical media such as floppy disks, and hardware devices that are specially configured to store and perform program instructions, such as read-only memory devices (ROM) and random access memory (RAM). Examples of program instructions include both machine codes, such as produced by a computer, and files containing higher level codes that may be executed by the computer using an interpreter.

While the present invention has been described with reference to the specific embodiments thereof, it should be understood, of course, that the foregoing relates to preferred embodiments of the invention and that modifications may be made without departing from the spirit and scope of the invention as set forth in the following claims.

In addition, many modifications may be made to adapt a particular situation, treatment, tissue sample, process, process step or steps, to the objective, sprit and scope of the present invention. All such modifications are intended to be within the scope of the claims appended hereto.

What is claimed is:

1. A system for checking printhead pattern data that control printing operations of a printhead in an inkjet printer, said system comprising:

a printhead controller configured to send printhead pattern data and a printhead interface configured to receive said printhead pattern data and fire printing nozzles in accordance with said printhead pattern data;

said printhead interface further comprising means for returning said printhead pattern data to said printhead controller upon firing said printhead nozzles in accordance with said printhead pattern data;

said printhead controller including first means for storing said printhead pattern data at the time that said printhead pattern data are sent to said printhead interface; second means for receiving said printhead pattern data from said means for returning, and means for comparing said printhead pattern data stored in said first means and received by said second means.

2. The system of claim 1, wherein said system determines that a print error has occurred when said means for comparing determines that said printhead pattern data stored in said first means do not match said printhead pattern data received by said second means.

3. The system of claim 1, wherein said first means for storing comprises a CRC circuit and a latch and said printhead pattern data are stored in the form of a cyclic redundancy code.

4. The system of claim 1, wherein said second means for receiving comprises a CRC circuit, and said printhead pattern data received are converted to a cyclic redundancy code.

5. The system of claim 1, wherein said printhead controller further comprises a parallel to serial shift register and converts said printhead pattern data from a parallel to a serial format prior to sending said printhead pattern data to said printhead interface and to said first means for storing.

6. The system of claim 5, wherein said printhead interface further comprises a serial to parallel shift register which converts said printhead pattern data received from a serial to a parallel format to fire said printhead nozzles.

7. The system of claim 6, wherein said means for returning said printhead pattern data return said printhead pattern data in serial format.

8. The system of claim 1, further comprising a printhead driver interconnected between said printhead controller and said printhead interface, wherein said printhead pattern data sent by and received by said printhead controller are sent and received in differential format, wherein printhead pattern data sent and received by said printhead interface are sent and received in non-differential format, and wherein said printhead driver converts said printhead pattern data going from said printhead controller to said printhead interface from said differential format to said non-differential format, and converts said printhead pattern data going from said printhead interface to said printhead controller from said non-differential format to said differential format.

9. The system of claim 1, further comprising means for determining a delay time for travel of said first printhead pattern data from said printhead controller to said printhead interface and back; and means for synchronizing storage of said first printhead pattern data received by said second means for receiving, based on said delay time.

10. A method of detecting printing errors due to erroneous printhead pattern data received by a printhead, said method comprising the steps of:

sending printhead pattern data from a printhead controller to a printhead interface in the printhead;

storing the printhead pattern data locally in the printhead controller;

receiving the printhead pattern data at the printhead controller from the printhead interface after firing printhead nozzles according to the printhead pattern data; and comparing the printhead pattern data stored locally with the printhead pattern data received.

11. The method of claim 10, wherein an error is determined if the printhead pattern data stored locally do not match the printhead pattern data received.

12. The method of claim 10, wherein the printhead pattern data are converted to a cyclic redundancy code prior to storing locally.

13. The method of claim 10, wherein the printhead pattern data received at the printhead controller are converted to a cyclic redundancy code.

14. The method of claim 10, further comprising determining a delay time for travel of said printhead pattern data from said printhead controller to said printhead interface and back; and synchronizing receiving of said printhead pattern data at the printhead controller, based on said delay time.

15. A method comprising forwarding a result obtained from the method of claim 10 to a remote location.

16. A method comprising transmitting data representing a result obtained from the method of claim 10 to a remote location.

17. A method comprising receiving a result obtained from a method of claim 10 from a remote location.

18. A computer readable medium carrying one or more sequences of pattern data for detecting printing errors due to erroneous printhead pattern data received by a printhead, wherein execution of one or more sequences of pattern data by one or more processors causes the one or more processors to perform the steps of:

sending printhead pattern data from a printhead controller to a printhead interface in the printhead;

storing the printhead pattern data locally in the printhead controller;

receiving the printhead pattern data at the printhead controller from the printhead interface after firing printhead nozzles according to the printhead pattern data; and comparing the printhead pattern data stored locally with the printhead pattern data received.

* * * * *